US006290539B1

(12) United States Patent
Wilber et al.

(10) Patent No.: US 6,290,539 B1
(45) Date of Patent: Sep. 18, 2001

(54) ELECTRICAL CONNECTOR HAVING A TWO-PIECE SOCKET PORTION

(75) Inventors: Darrin F. Wilber, Metamora; Robert J. Flowers, Ortonville, both of MI (US)

(73) Assignee: Cardell Corporation, Auburn Hills, MI (US)

( * ) Notice: Subject to any disclaimer, the term of this patent is extended or adjusted under 35 U.S.C. 154(b) by 0 days.

(21) Appl. No.: 09/302,991

(22) Filed: Apr. 30, 1999

(51) Int. Cl.[7] ..... H01R 13/40
(52) U.S. Cl. ..... 439/595
(58) Field of Search ..... 439/489, 701, 439/595, 752

(56) References Cited

U.S. PATENT DOCUMENTS

| | | | | |
|---|---|---|---|---|
| 4,370,013 | | 1/1983 | Niitsu et al. | 439/352 |
| 4,634,204 | | 1/1987 | Detter et al. | 439/352 |
| 4,971,580 | | 11/1990 | Ward et al. | 439/595 |
| 4,984,998 | | 1/1991 | Duncan et al. | 439/352 |
| 5,120,255 | | 6/1992 | Kouda et al. | 439/489 |
| 5,217,390 | | 6/1993 | Nozaki et al. | 439/489 |
| 5,234,356 | | 8/1993 | Maejima et al. | 439/352 |
| 5,292,261 | * | 3/1994 | Hirano et al. | 439/752 |
| 5,322,457 | * | 6/1994 | Tsuji et al. | 439/595 |
| 5,370,543 | | 12/1994 | Hamada et al. | 439/188 |
| 5,507,666 | | 4/1996 | Yamanashi | 439/666 |
| 5,522,740 | | 6/1996 | Plocek et al. | 439/595 |
| 5,573,430 | | 11/1996 | Hatagishi | 439/701 |
| 5,605,472 | | 2/1997 | Sakai et al. | 439/489 |
| 5,628,648 | | 5/1997 | Higgins, Jr. et al. | 439/489 |
| 5,681,178 | | 10/1997 | Kunkle et al. | 439/352 |
| 5,700,163 | | 12/1997 | Okabe | 439/596 |
| 5,720,623 | | 2/1998 | Polenick et al. | 439/352 |
| 5,759,058 | | 6/1998 | Childs et al. | 439/352 |
| 5,839,915 | | 11/1998 | Ford et al. | 439/489 |

* cited by examiner

*Primary Examiner*—Tulsidas Patel
(74) *Attorney, Agent, or Firm*—Jones, Tullar & Cooper, PC

(57) ABSTRACT

A connector component includes a housing portion and an insert portion. The insert portion includes a plurality of terminal-receiving passages. Conductive terminals may be inserted into the passages, and a ramped fixed shoulder is formed on each passage surface for retaining the terminals in the passage. Additionally, a flexible finger is provided for each passage for holding the terminals in position in the passage. A terminal may be loaded into each passage and disposed in front of the shoulder. The housing portion of the invention includes a generally box-shaped casing having a hollow cavity for receiving the insert portion of the invention. Each of the upper and lower walls includes a transverse step formed along the expanse between the side walls. The upper and lower walls further include a transverse ramped locking area which also extends between the side walls. The transverse step serves as part of a terminal position assurance ("TPA") system for preventing assembly of the insert portion into the housing if a terminal is not properly seated in its passage. When a terminal is not properly seated, the finger for that passage will extend outward more than the remaining fingers, and this finger will contact the transverse step on the upper or lower wall. The step will prevent further insertion of the insert and alert a technician assembling the component as to the incorrectly positioned terminal. However, when all terminals are properly seated, there is sufficient clearance for the insert to be completely inserted into the housing. As complete insertion occurs, the fingers on the insert contact the ramped locking area. The ramped area forces the fingers against the terminals, thereby securely locking the terminals in position.

20 Claims, 5 Drawing Sheets

3d
3e
16
20
70
72
74
76
78
80
82
84
86
92
94
100

ELECTRICAL CONNECTOR HAVING A TWO-PIECE SOCKET PORTION

BACKGROUND OF THE INVENTION

1. Field of the Invention

The present invention generally relates to an electrical connector system, and, more particularly, to a two-piece component of a connector having a terminal position assurance feature for giving mechanical and visual assurance that the terminals are properly installed in the connector component and for locking the terminals in position.

2. Description of the Prior Art

An electrical connector typically includes a pair of mateable connector housing components or halves constructed from a dielectric material. The housing halves are usually identified as a plug half (or male half) and a socket half (also referred to as the receptacle half or female half). The two connector halves have complementary inter-engaging conductive terminals for completing an electrical circuit when the housing halves are fully and properly mated. The plug half generally has one or more projecting conductive pins which are inserted into one or more conductive receptacles or sockets on the socket half. The contact between the pin terminals and socket terminals forms the electrical connection between the two connector halves.

The pin and socket terminals are typically small components manufactured from wire and stamped sheet metal materials. Proper placement of the terminals in the dielectric housings of the connector halves is important for ensuring an electrical connection. If one or more terminals is not seated properly in its respective housing half, then a poor quality or incomplete electrical connection may exist when the two housing halves are assembled. This improper seating of the terminals may occur, for example, during initial placement of the terminals into the connector housing, during processing or shipment prior to final assembly of the connector halves, during assembly of the connector halves, or following assembly due to vibrations, external stress, or the like, such as if a terminal is pulled from its fully seated position within the connector housing.

Failures due to improper terminal seating are of particular concern in the automotive industry. Connectors on vehicles are subjected to extreme weather conditions, continual vibrations, and occasional rough treatment during repair, maintenance, or the like. To avoid connector failures, the automotive industry may require that connectors include some form of terminal position assurance ("TPA") system to provide a visual, mechanical, or other type of assurance that the terminals are properly installed in the connector. A locking mechanism for holding the terminals in the connector housing may also be required. The TPA arrangement may be part of this locking action, or may be separate from the locking mechanism.

In the past, different techniques have been used to provide terminal position assurance for terminals within a connector housing, including pin and socket type terminal systems. For example, U.S. Pat. No. 5,522,740, to Plocek et al., discloses an electrical connector having a TPA insert which detects whether or not a terminal is properly installed. The connector includes the TPA insert which contains a number of terminal-receiving passages. The TPA insert is partially inserted into a connector housing, and the terminals are then inserted into the passages. The terminals include first openings which receive a locking finger portion of the connector housing when the terminals are inserted. Following insertion of all the terminals, the TPA insert is moved to the fully-inserted position, and locking arms on the TPA insert enter second openings in the terminals. If a terminal is not quite properly seated, the TPA insert can seat the terminal when the TPA insert is moved forward. When the TPA insert is in the forward position, the terminals are locked in place. Because the terminals are engaged with both the housing and the TPA insert, a special tool is required to remove the TPA insert or terminals from the final locked position.

U.S. Pat. No. 5,573,430, to Hatagishi, shows another type of two-piece connector component which includes a housing portion which receives an insert portion in which a plurality of terminals are mounted. The insert and housing include a number of guide projections, contact projections, and vibration-preventing projections for securely holding the terminals in position following assembly. However, Hatagishi does not appear to include any arrangements for providing a TPA system which will prevent assembly of the insert into the housing if the terminals are not properly seated.

While the prior art connector components and TPA arrangements function effectively for their intended applications, some of the components may be complex to mold, or to assemble and disassemble. Accordingly, it is desirable to provide an alternative connector and TPA arrangement whose functional components enable a simpler and more compact construction than those of the prior art, without sacrificing strength and functionality. The two-piece connector component and TPA system of the present invention provide these and other benefits, and overcome the shortcomings associated with the prior art.

SUMMARY OF THE INVENTION

In the preferred form, the invention is described as a socket component of a two-part mateable connector system. However, the invention may also be formed as a panel mounted socket, a plug component of a connector, or other similar connector by making slight modifications to the housing configuration. Accordingly, these alternative configurations are also considered to be within the scope of the invention. The socket component of the invention includes a housing portion and an insert portion. The housing portion of the socket component is configured to mate to a plug component having projecting pin terminals for forming an electrical connection. A latch mechanism and connector position assurance device may be included on the socket component for securely latching the socket component to the plug component following assembly of the two connector halves.

The insert of the invention includes a main body which is generally rectangular in cross section. The main body has a planar surface centrally disposed therein and extending outward from the main body to form a distal edge. Generally rectangular side plates are located on either side of the planar surface and are integrally formed perpendicularly to the planar surface. The side plates extend from the main body to the distal edge of the horizontal body. A plurality of parallel terminal-receiving passages are formed by a plurality of generally parallel partitions disposed perpendicularly to the horizontal body in a cross-wise fashion. The partitions extend from the proximal side of the main body to the distal edge of the planar surface. Conductive terminals may be inserted into the passages and a ramped fixed shoulder is formed in each passage on the planar surface for retaining the terminals in the passage. Additionally, a flexible finger is provided for each passage for holding the terminals in position in the passage. Each flexible finger extends distally from the main body over one of the passages, and the distal tip of the finger contacts the terminal and provides resilient bias against the terminal when the terminal is installed in the passage. A terminal may be loaded into each passage in the insert and disposed in front of the fixed shoulder on the horizontal surface so that the tip of the terminal is adjacent to the distal edge of the horizontal surface, and the rear of the terminal abuts the fixed shoulder.

The housing portion of the invention includes a generally box-shaped casing having an upper wall, a lower wall, a pair of sidewalls, a front wall, and an open rear side, so that a hollow cavity is formed for receiving the insert portion of the invention. Guides are formed along the sidewalls on the inside of the housing cavity for contacting and guiding the side plates of the insert portion during insertion of the insert portion into the housing portion. Each of the upper and lower walls of the housing portion includes a transverse step formed along the expanse between the side walls. The upper and lower walls further include a transverse ramped locking area which also extends between the two side walls.

The transverse step serves as part of a TPA system for preventing assembly of the insert portion into the housing portion if a terminal is not properly seated in one of the passages. When a terminal is not properly seated in a passage, the finger for that passage will extend outward more than the rest of the fingers, and this finger will contact the transverse step on the upper or lower wall. The transverse step will prevent further insertion of the insert and alert a technician assembling the component as to the incorrectly positioned terminal. When all terminals are properly seated, there is sufficient clearance between the fingers and the transverse steps to allow the insert portion to be completely inserted into the housing portion. Furthermore, as complete insertion occurs, the fingers on the insert contact the ramped locking area. The ramped locking area forces the fingers against the terminals, thereby securely locking the terminals in position. Thus, the configuration of the invention also provides a locking feature to prevent dislodgement of the terminals.

Accordingly, the present invention provides a reliable and ergonomic connector component, TPA mechanism, and locking mechanism. The present invention ensures correct and secure positioning of terminals, and correct assembly of a connector component, while also preventing unintentional removal of the terminals. Furthermore, while the preferred embodiment of the invention is described in conjunction with a socket component for a particular two-part electrical connector for a wiring harness, it may be equally well used with other connector applications, such as pin-type terminals, plug components, or the like, and is not limited to use with the particular socket component shown.

BRIEF DESCRIPTION OF THE DRAWINGS

The foregoing and additional objects, features, and advantages of the present invention will become apparent to those of skill in the art from a consideration of the following detailed description of a preferred embodiment of the invention, taken in conjunction with the accompanying drawings.

FIG. 1 includes a CPA device, a plug component of a connector, and a socket component of the preferred embodiment of the present invention illustrating the insert portion and the housing portion.

DETAILED DESCRIPTION

Figure 1:
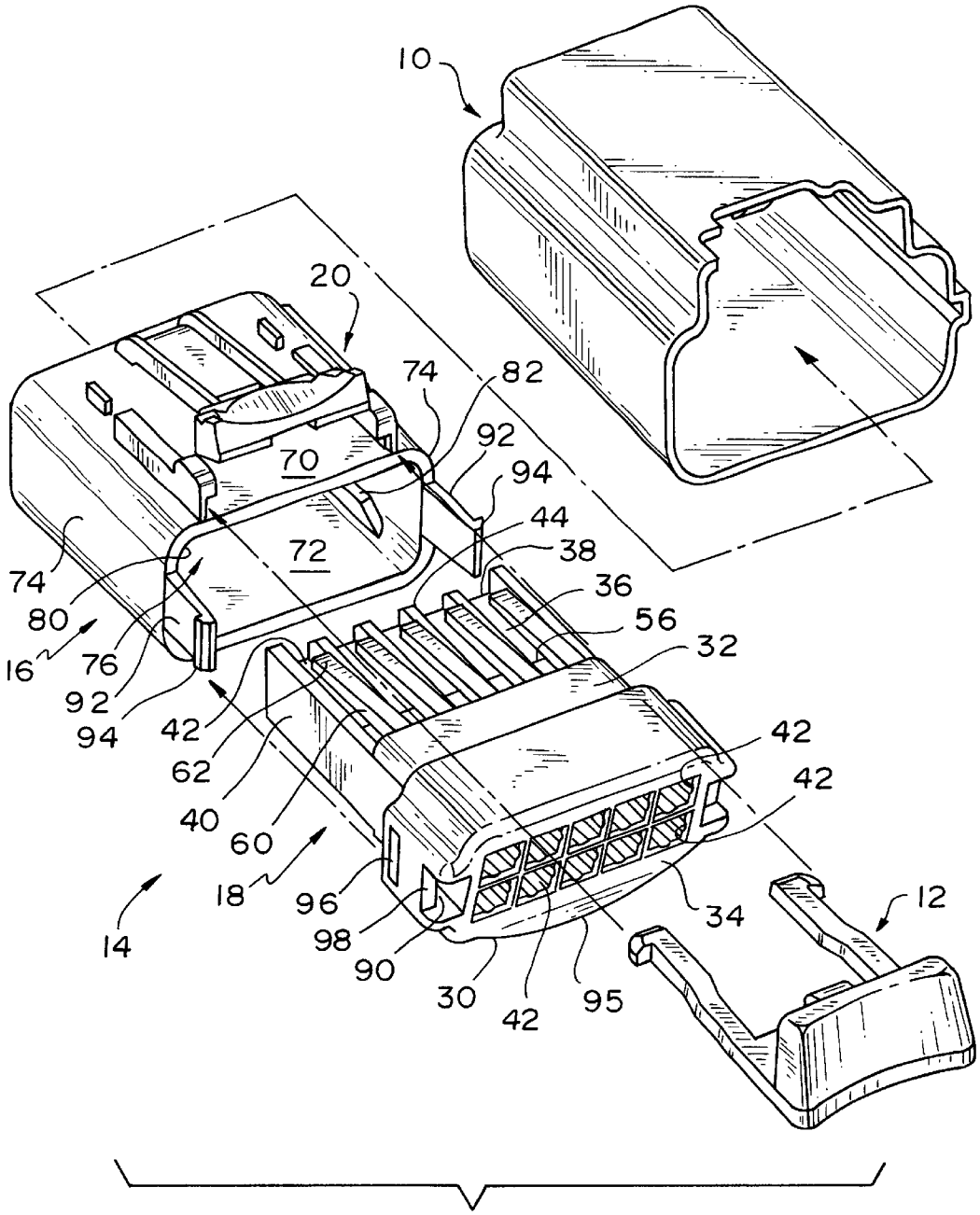
FIG. 1 illustrates a perspective view of a connector system incorporating the connector component of the invention.

Turning now to a more detailed description of the present invention, there is illustrated in FIG. 1 a preferred embodiment of an electrical connector system including a plug connector component 10, a connector position assurance ("CPA") device 12, and a two-piece socket connector component 14 in accordance with the present invention. Socket component 14 is designed as a two-part assembly and comprises a connector housing portion 16 and a connector insert portion 18. Housing portion 16 and insert portion 18 are arranged so that insert portion 18 may be placed into housing portion 16 to facilitate installation of conductive terminals (not shown in FIG. 1). Socket component 14 is designed to receive a plurality of socket-type terminals (not shown). Plug component contains a plurality of pin-type terminals (not shown). Socket component 14 may be inserted into plug component 10 for forming an electrical connection. During insertion of socket component 14 into plug component 10, the pin terminals enter into the socket terminals for making the electrical connection, as is known in the art.

A latch mechanism 20 is provided on housing portion 16 for latching socket component 14 to the plug component 10 during assembly. Following assembly of socket component 14 and plug component 10, CPA device 12 may be used to lock the connector components 10, 14 together in the latched condition. Latch mechanism 20 and CPA device 12 are described in more detail in applicants' co-pending patent application entitled "CONNECTOR POSITION ASSUR- ANCE DEVICE", filed on an even date herewith, to the same inventors as herein, to the same assignee as herein, under U.S. patent application Ser. No. 09/302,992, and the disclosure of which is incorporated herein by reference.

As illustrated in FIGS. 2*a*–2*d*, insert portion 18 includes a main body 30 which is generally rectangular in cross section, and which includes a mating end 32 and a non-mating proximal end 34. Main body 30 has a planar surface 36 centrally disposed in main body 30 when viewed from either end 32, 34. Planar surface 36 extends from the proximal end 34 of main body 30, through main body 30, and outward from the mating end 32 of main body 30 to form a distal edge 38. Generally rectangular side plates 40 are located on either side of planar surface 36 and are integrally formed perpendicularly to the major plane of planar surface 36. Side plates 40 extend from mating end 32 of main body 30 to distal edge 38 of planar surface 36.

Figure 4:
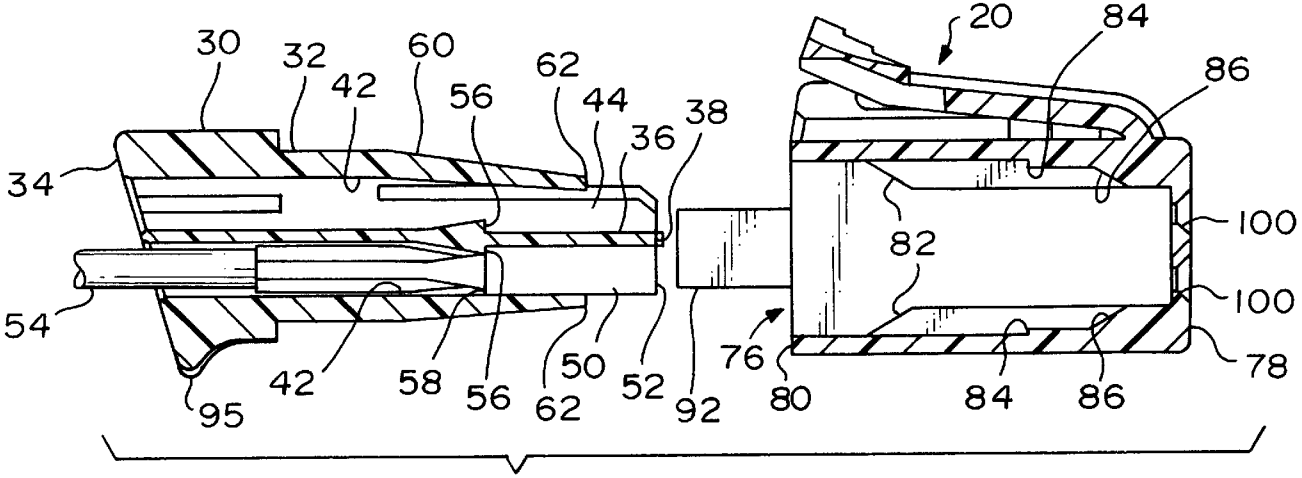
FIG. 4 illustrates a cross sectional view of the insert portion and the housing portion prior to insertion, with a terminal located in one of the passages.

A plurality of parallel terminal-receiving channels or passages 42 are formed by a plurality of generally parallel spaced partitions 44 disposed perpendicularly to horizontal surface 36 in a cross-wise fashion. Partitions 44 are generally rectangular and extend through main body 30 from proximal end 34 to the distal edge 38 of planar surface 36. As also illustrated in FIG. 4, conductive terminals 50 may be inserted into passages 42 through proximal end 34, with one terminal 50 being placed in each passage 42. During installation, each terminal 50 is inserted into a passage 42 until the terminal tip 52 is adjacent to distal edge 38 of planar surface 36. A conductive wire 54 is attached to each terminal 50, and extends back through passage 42 and out of proximal end 34.

To retain terminals 50 in passages 42, a ramped fixed shoulder 56 is formed on planar surface 36 in each passage 42. Once a terminal 50 is installed in a passage 42, the rear edge 58 of terminal 50 butts up against fixed shoulder 56 for preventing movement of terminal 50 toward proximal end 34 of insert portion 18. Additionally, to further retain terminals 50 within passages 42, flexible fingers 60 are provided extending distally of mating end 32 in a cantilevered fashion. Fingers 60 extend over passages 42 so that one finger 60 extends over each passage 42 for holding terminals 50 in position in passages 42. Distal tips 62 of each finger 60 contact terminals 50 and provide resilient bias against terminals 50 when terminals 50 are installed in passages 42. The inherent resilient bias of fingers 60 aids in holding terminals 50 in position in passages 42 both during installation and following assembly. Furthermore, insert portion 18 and housing portion 16 may be constructed of any suitable material, but are preferably molded from dielectric thermoplastic having sufficient inherent resilience to allow portions of the components, such as fingers 60 and latch mechanism 20, to flex under force and then recoil to their initial configurations.

As illustrated in FIGS. 3*a*–3*e*, housing portion 16 is formed as a generally box-shaped casing having an upper wall 70, a lower wall 72, a pair of sidewalls 74, a front wall 78, and an open rear side 80, so that a hollow cavity 76 is formed for receiving insert portion 18 of the invention. Two sets of guides 82 are formed along sidewalls 74 on the inside of housing 16. Guides 82 are provided to contact and guide side plates 40 during insertion of insert portion 18 into housing portion 16. Guides 82 ramp away from upper wall 70 and lower wall 72 so that insert portion 18 may be easily inserted into housing 16 and automatically centered.

Figure 7:
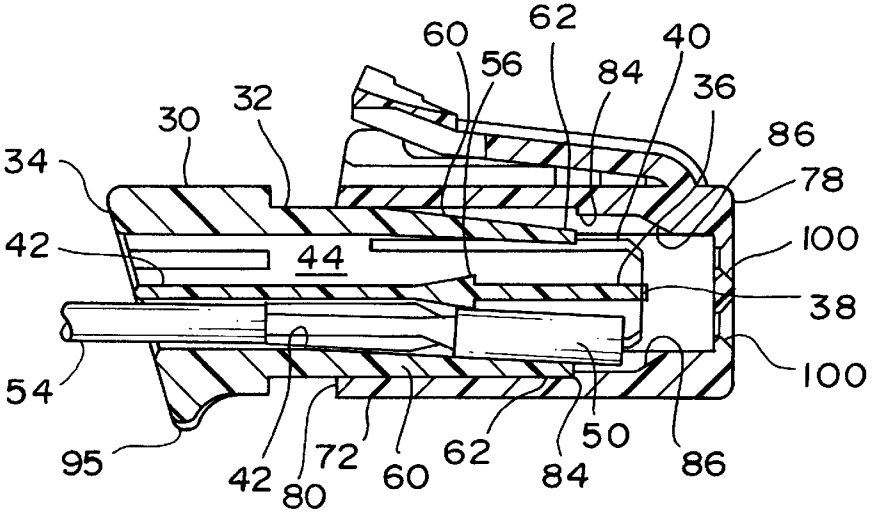
FIG. 7 illustrates a cross-sectional view of the insert portion being inserted into the housing portion with a misaligned terminal in one of the passages, thereby illustrating the TPA feature of the invention.

In addition, upper wall 70 and lower wall 72 each include a transverse step 84 formed across their expanse between side walls 84. Steps 84, along with fingers 60, serve as a TPA system for preventing assembly of insert portion 18 into housing portion 16 if a terminal 50 is not properly seated in its passage 42. As illustrated in FIG. 7, when a terminal 50 is not properly seated, the finger 60 bearing against that terminal 50 will extend outward to a greater extent than the remaining fingers 60. Distal tip 62 of this protruding finger 60 will contact step 84 on upper wall 70 or lower wall 72. Step 84 will prevent further insertion of insert portion 18 and alert a technician assembling the component 14 as to the incorrectly positioned terminal 50. However, when all terminals 50 are properly seated, there is sufficient clearance between steps 84 and fingers 60 to allow insert portion 18 to be completely inserted into housing portion 16.

Housing portion 16 further includes transversely-formed ramped locking areas 86. Ramped locking areas 86 extend transversely across upper wall 70 and lower wall 72 between sidewalls 74. Locking areas 86, along with fingers 60 and fixed shoulders 56, serve as a locking mechanism for securing terminals 50 within passages 42. Following proper installation of terminals 50 into passages 42, insert portion 18 is moved from the pre-lock position illustrated in FIGS. 5*a* and 5*b* to the fully locked position illustrated in FIGS. 6*a* and 6*b*. During full insertion of insert portion 18 into housing 16, fingers 60 contact ramped locking areas 86. Locking areas 86 forces fingers 60 tightly against terminals 50, thereby securely locking terminals 50 in position in passages 42. The proximity of fingers 60, combined with the solid stop of fixed shoulder 56 and the proximity of front wall 78 all serve to securely retain terminals 50 in position and prevent their removal.

Figure 5B:
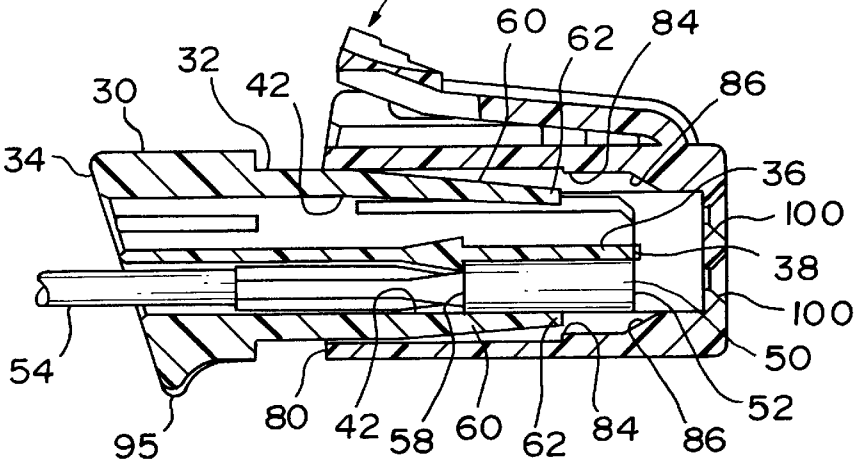
FIG. 5*b* illustrates a cross-sectional view of the assembly of FIG. 5*a*.
Figure 5A:
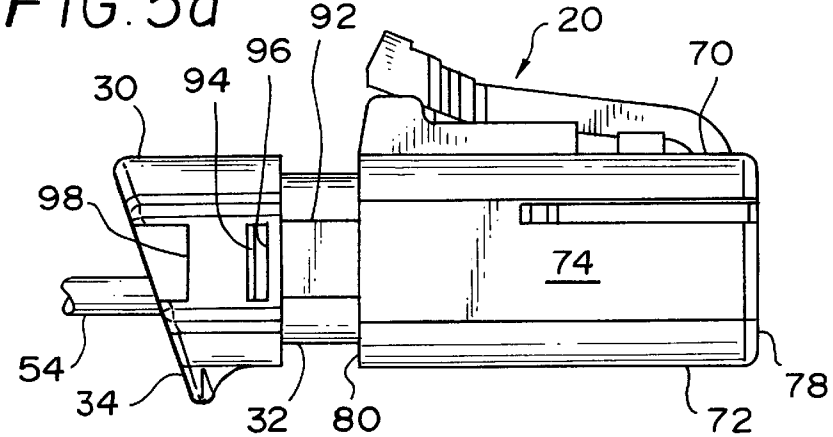
FIG. 5*a* illustrates a side view of the insert portion and the housing portion in the pre-lock position, during which terminals might typically be inserted into the terminal passages.
Figure 6B:
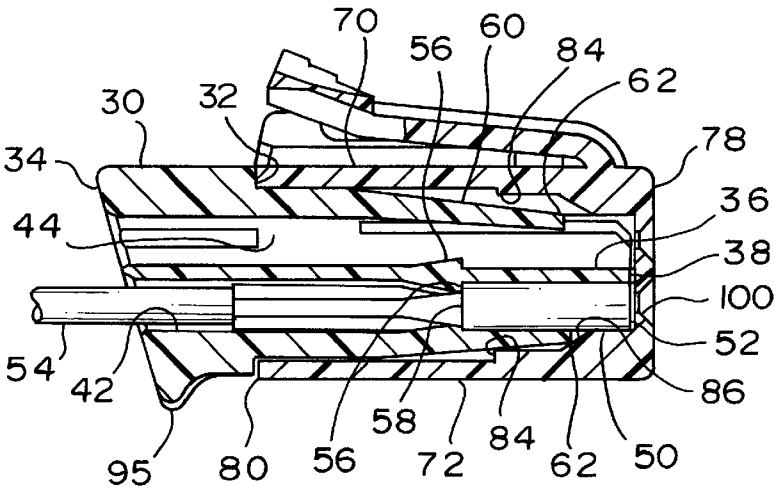
FIG. 6*b* illustrates a cross-sectional view of the assembly illustrated in FIG. 6*a*.
Figure 6A:
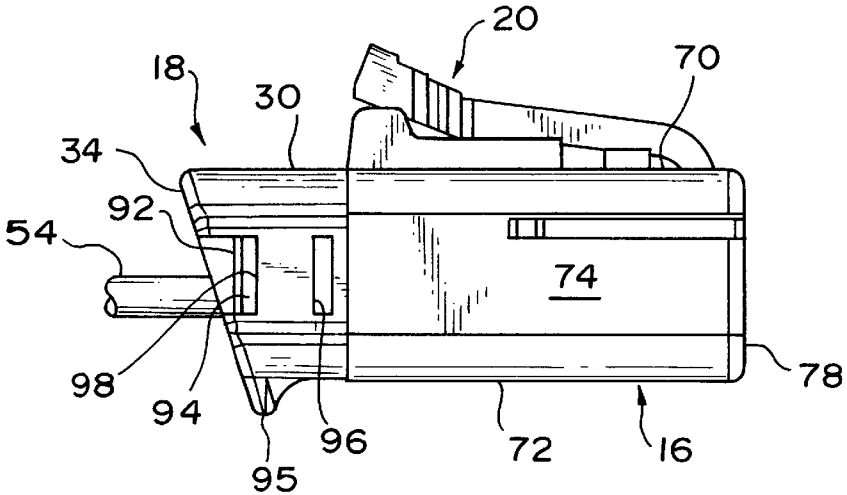
FIG. 6*a* illustrates a side view of the insert portion and the housing portion with the insert portion fully inserted to the locked position.

To enable insert portion 18 to be securely installed in housing 16, main body 30 of insert portion 18 includes latch portals 90 formed on either side. Latch portals 90 are configured to receive rearwardly-extending latch arms 92 located on either side of housing portion 16. Latch arms 92 include locking tabs 94 formed on their ends. A pre-lock aperture 96 is formed in the side of each latch portal 90 for receiving locking tabs 94 and for retaining insert portion 18 assembled to housing portion 16 in a pre-lock position, as illustrated in FIGS. 5*a* and 5*b*, and the purpose of which will be described below. When insert portion 18 is fully inserted into housing portion 16, as illustrated in FIGS. 6*a* and 6*b*, tabs 94 are slid further back and exit the proximal sides 98 of latch portals 90. Locking tabs 94 engage with the proximal sides 98 of latch portals 90 for securely locking insert portion 18 to housing portion 16. Once this configuration is reached, insert portion 18 cannot be removed from housing portion 16 until tabs 94 are manually disengaged from the proximal sides 98 of latch portals 90. This may be accomplished by flexing tabs 94 inward and sliding insert portion 18 away from housing portion 16. A projecting grip area 95 may be provided on main body 30 of insert portion 18 for facilitating removal of insert portion 18 from housing portion 16.

In use, insert portion 18 is inserted into cavity 76 of housing portion 16 and moved to the pre-lock position illustrated in FIGS. 5*a* and 5*b*. This is the preferred position for inserting terminals 50 into passages 42. (Although alternatively, terminals 50 may be installed prior to insertion of insert 18 into housing 16, as illustrated in FIG. 4.) In the pre-lock position, tabs 94 are located in pre-lock apertures 96 in latch portals 90, and distal tips 62 of fingers 60 have not yet reached steps 84. A desired number of terminals 50 are then installed into passages 42, one per passage, and typically, all of passages 42 will receive a terminal 50. Terminals 50 are installed by inserting a terminal 50 into a passage 42 and pushing terminal 50 forward. As terminals 50 are pushed forward, forward tip 52 will ride up ramped fixed shoulder 56, causing finger 60 to flex outward. Then as rear edge 58 of terminal 50 passes ramped fixed shoulder 56, the resilience of finger 60 will force terminal 50 back against planar surface 30, snapping terminal 50 into the installed position. Once all terminals 50 are installed, insert portion 18 is pushed forward into housing 16. If terminals 50 are too far forward, ramp locking areas 86 and front wall 78 will force terminals 50 back against fixed shoulder 56. If a terminal 50 is not completely installed, as illustrated in FIG. 7, the finger 60 adjacent to that terminal 50 will project outward and contact step 84 as insert portion 18 is moved toward the full locked position. This will alert the technician assembling component 14 that a terminal 50 is improperly positioned. The technician will then be able to check the positions of terminals 50 within passages 42.

When insert portion 18 is moved to the full locked position, locking tabs 94 engage with proximal edges 98 of latching portals 90, securely holding insert portion 18 within housing portion 16. In the full locked position, locking areas 86 prevent any movement of fingers 60. Thus, terminals 50 are locked in position within passages 42 by fixed shoulders 56, fingers 60, and front wall 78 of housing portion 16. In this position, terminals 50 are aligned with terminal openings 100. Terminal openings 100 pass through front wall 78, and enable pin-type terminals (not shown) to be inserted to form an electrical connection with terminals 50. To remove terminals 50 from passages 42, insert portion 18 must first be unlatched from housing portion 16 by releasing tabs 94 from engagement with latching portals 90. This is accomplished by flexing latch arms 92 inward, and, accordingly, no special tools are required for disassembly.

From the foregoing it will be apparent that there is provided a novel TPA system and locking mechanism for use in securing terminals within a connector component. The TPA system prevents assembly of components in which the terminals are not properly seated. Furthermore, the present invention locks the terminals in position without requiring holes in the terminals 50 or positive connection of the terminals to the housing portion 16 of component 14. In addition, the insert portion 18 may be removed from the housing portion 16 easily and without special tools. Thus, although the present invention has been described in terms of preferred embodiments, it will be apparent that variations and modifications may be made without departing from the true spirit and scope thereof, as set forth in the following claims.

What is claimed:

1. A connector component for receiving at least one conductive terminal, said component comprising:

an insert portion, said insert portion having at least one passage for receiving a terminal, said inert portion further having a resilient finger extending over said passage for contacting the terminal;

a shoulder for abutting against a portion of the terminal for preventing removal of the terminal from said passage, said shoulder being formed in said passage on a surface opposite to said resilient finger so that the terminal is retained against said shoulder by said finger; and a housing portion having a cavity for receiving said insert, said housing portion including a ramped locking area within said cavity, whereby, when said insert portion is inserted into said housing portion, said ramped locking area prevents said finger from flexing away from the terminal, thereby retaining the terminal in contact with said shoulder so that the terminal is securely retained within said passage.

2. A method of searching for functional defects in a description of a circuit with at least a controller capable of tensioning between a plurality of states, the method comprising:

simulating the functional behavior of said circuit in response to a first test vector, wherein the simulation has a current state, prior to said act of simulating;

automatically restoring the simulation after said simulating act to said current state, without causing the simulation to pass through a reset state, wherein said reset state being a state of the simulation in response to a simulated reset signal;

determining next states including a plurality of non-simulated states that can be reached from the current state;

simulating the functional behavior of said circuit in response to a second test vector, after said act of automatically restoring; and generating descriptions of additional circuits that monitor portions of the circuit that are under verification, and during simulation each additional circuit is coupled to an instance of an arrangement of circuit elements associated with a known defective behavior.

3. The component of claim 1 wherein said ramped locking area forces said finger tightly against said terminal, thereby forcing said terminal tightly against said shoulder and said surface of said passage.

4. A method of simulating a circuit description, the method comprising:

performing a first simulation for finding defects of said circuit description in response to a first test vector, wherein said circuit description has at least a controller capable of transitioning between a plurality of states and a current state prior to said first simulation;

automatically restoring said first simulation to said current state after said first simulation, without passing through a reset state, wherein said reset state is a simulated state determined by a simulated reset signal;

determining next states including a plurality of non-simulated states that are reachable from the current state; and performing a second simulation of said circuit description in response to a second test vector, after said act of automatically restoring said first simulation, thereby facilitating a faster method of simulation.

5. The method of claim 4, wherein said circuit description includes at least a first controller capable of performing a plurality of first state transitions and a second controller capable of performing a plurality of second state transitions, the method further comprising automatically enumerating for said first simulation and for said second simulation the number of times said first state transitions and said second state transitions occur simultaneously.

6. The method of claim 4 further comprising automatically applying a predetermined rule to identify said second test vector to transition from the current state to the next state, wherein the next state is a simulated or non-simulated state.

7. The method of claim 4 further comprising:

automatically enumerating said first state transition and said second state transition; and automatically applying a predetermined rule to identify said second test vector, wherein an input to said predetermined rule is at least one of said first and said second state transitions.

8. The method of claim 4, wherein said circuit description includes at least a first controller capable of performing a plurality of first state transitions and a second controller capable of performing a plurality of second state transitions, the method further comprising:

automatically enumerating for each of said simulating acts, the number of said first state transitions and said second state transitions occurring simultaneously; and automatically applying a predetermined rule to identify said second test vectors, wherein an input to said predetermined rule is at least one of said first and said second state transitions.

9. The component of claim 8 wherein said housing further includes a top wall, a bottom wall and a pair of side walls for forming said cavity, and a transverse step formed in at least one of said top wall or said bottom wall, said transverse step being positioned for contacting said finger if the terminal is not properly seated within said passage.

10. The component of claim 9 wherein at least one of said top wall or bottom wall includes a ramped locking area for preventing movement of said finger away from the terminal following complete insertion of said insert portion into said housing portion.

11. The component of claim 10 wherein said ramped locking area forces said finger more tightly against said terminal, thereby forcing said terminal more tightly against said shoulder and said surface of said passage.

12. The component of claim 8 further including a planar surface which forms said surface of said passage opposed to said finger, and further wherein there are a plurality of said passages, each said passage being formed at least in part by a plurality of generally parallel spaced partitions disposed perpendicularly to said planar surface, each said passage having one of said fingers extending over said passage.

13. The component of claim 8 wherein said insert portion includes a latch portal located on said main body, said latch portal being configured for receiving a latch arm on said housing portion for latching said insert portion to said housing portion in the fully locked position.

14. The component of claim 13 wherein said latch portal further includes a pre-lock aperture for latching said insert portion in an intermediate pre-lock configuration within said housing portion.

15. A method of simulating a circuit description, the method comprising:

performing inside a computer a first simulation of said circuit description in response to a first test vector;

automatically restoring said first simulation to said current state after said first simulation, without passing through a reset state, wherein said reset state is a simulated state determined by a simulated reset signal;

determining inside a computer next states including a plurality of non-simulated states that are reachable from the current state; and performing a second simulation of said circuit description in response to a second test vector, after said act of automatically restoring said first simulation, thereby facilitating a faster method of simulation.

16. The combination of claim 15 further including a planar surface extending from said main body to said distal edge and which forms said surfaces of said passages opposite to said fingers, and further wherein each said passage is formed at least in part by a plurality of generally parallel spaced partitions disposed perpendicularly to said planar surface.

17. The combination of claim 15 wherein said insert portion includes a latch portal located on said main body, said latch portal being configured for receiving a latch arm located on said housing portion for latching said insert portion to said housing portion when said insert portion is fully inserted into said cavity.

18. A method of simulating a circuit description, the method comprising:

performing inside a computer a first simulation of said circuit description in response to a first test vector;

automatically restoring said first simulation to a current state after said first simulation, without passing through a reset state, wherein said reset state is a simulated state determined by a simulated reset signal; and performing a second simulation from said current state, thereby facilitating a aster method of simulation.

19. The combination of claim 15 wherein said housing portion includes an upper wall, a lower wall, and a pair of side walls, with a step extending transversely between said sidewalls on each of said upper and lower walls for contacting said fingers if one or more of said terminals are not properly seated in one or more of said passages.

20. The combination of claim 15 wherein said ramped locking area forces said fingers more tightly against said terminals, thereby forcing said terminals more tightly against said shoulders and said surfaces of said passages.

* * * * *

UNITED STATES PATENT AND TRADEMARK OFFICE

CERTIFICATE OF CORRECTION

PATENT NO. : 6,290,539 B1 
DATED : September 18, 2001
INVENTOR(S) : Darrin F. Wilber et al.

It is certified that error appears in the above-identified patent and that said Letters Patent is hereby corrected as shown below:

Columns 1-10,
Should be deleted, and substitute therefor columns 1-10, as shown on the attached pages.

Signed and Sealed this

Third Day of June, 2003

JAMES E. ROGAN
*Director of the United States Patent and Trademark Office*

ELECTRICAL CONNECTOR HAVING A TWO-PIECE SOCKET PORTION

BACKGROUND OF THE INVENTION

1. Field of the Invention

The present invention generally relates to an electrical connector system, and, more particularly, to a two-piece component of a connector having a terminal position assurance feature for giving mechanical and visual assurance that the terminals are properly installed in the connector component and for locking the terminals in position.

2. Description of the Prior Art

An electrical connector typically includes a pair of mateable connector housing components or halves constructed from a dielectric material. The housing halves are usually identified as a plug half (or male half) and a socket half (also referred to as the receptacle half or female half). The two connector halves have complementary inter-engaging conductive terminals for completing an electrical circuit when the housing halves are fully and properly mated. The plug half generally has one or more projecting conductive pins which are inserted into one or more conductive receptacles or sockets on the socket half. The contact between the pin terminals and socket terminals forms the electrical connection between the two connector halves.

The pin and socket terminals are typically small components manufactured from wire and stamped sheet metal materials. Proper placement of the terminals in the dielectric housings of the connector halves is important for ensuring an electrical connection. If one or more terminals is not seated properly in its respective housing half, then a poor quality or incomplete electrical connection may exist when the two housing halves are assembled. This improper seating of the terminals may occur, for example, during initial placement of the terminals into the connector housing, during processing or shipment prior to final assembly of the connector halves, during assembly of the connector halves, or following assembly due to vibrations, external stress, or the like, such as if a terminal is pulled from its fully seated position within the connector housing.

Failures due to improper terminal seating are of particular concern in the automotive industry. Connectors on vehicles are subjected to extreme weather conditions, continual vibrations, and occasional rough treatment during repair, maintenance, or the like. To avoid connector failures, the automotive industry may require that connectors include some form of terminal position assurance ("TPA") system to provide a visual, mechanical, or other type of assurance that the terminals are properly installed in the connector. A locking mechanism for holding the terminals in the connector housing may also be required. The TPA arrangement may be part of this locking action, or may be separate from the locking mechanism.

In the past, different techniques have been used to provide terminal position assurance for terminals within a connector housing, including pin and socket type terminal systems. For example, U.S. Pat. No. 5,522,740, to Plocek et al., discloses an electrical connector having a TPA insert which detects whether or not a terminal is properly installed. The connector includes the TPA insert which contains a number of terminal-receiving passages. The TPA insert is partially inserted into a connector housing, and the terminals are then inserted into the passages. The terminals include first openings which receive a locking finger portion of the connector housing when the terminals are inserted. Following insertion of all the terminals, the TPA insert is moved to the fully-inserted position, and locking arms on the TPA insert enter second openings in the terminals. If a terminal is not quite properly seated, the TPA insert can seat the terminal when the TPA insert is moved forward. When the TPA insert is in the forward position, the terminals are locked in place. Because the terminals are engaged with both the housing and the TPA insert, a special tool is required to remove the TPA insert or terminals from the final locked position.

U.S. Pat. No. 5,573,430, to Hatagishi, shows another type of two-piece connector component which includes a housing portion which receives an insert portion in which a plurality of terminals are mounted. The insert and housing include a number of guide projections, contact projections, and vibration-preventing projections for securely holding the terminals in position following assembly. However, Hatagishi does not appear to include any arrangements for providing a TPA system which will prevent assembly of the insert into the housing if the terminals are not properly seated.

While the prior art connector components and TPA arrangements function effectively for their intended applications, some of the components may be complex to mold, or to assemble and disassemble. Accordingly, it is desirable to provide an alternative connector and TPA arrangement whose functional components enable a simpler and more compact construction than those of the prior art, without sacrificing strength and functionality. The two-piece connector component and TPA system of the present invention provide these and other benefits, and overcome the shortcomings associated with the prior art.

SUMMARY OF THE INVENTION

In the preferred form, the invention is described as a socket component of a two-part mateable connector system. However, the invention may also be formed as a panel mounted socket, a plug component of a connector, or other similar connector by making slight modifications to the housing configuration. Accordingly, these alternative configurations are also considered to be within the scope of the invention. The socket component of the invention includes a housing portion and an insert portion. The housing portion of the socket component is configured to mate to a plug component having projecting pin terminals for forming an electrical connection. A latch mechanism and connector position assurance device may be included on the socket component for securely latching the socket component to the plug component following assembly of the two connector halves.

The insert of the invention includes a main body which is generally rectangular in cross section. The main body has a planar surface centrally disposed therein and extending outward from the main body to form a distal edge. Generally rectangular side plates are located on either side of the planar surface and are integrally formed perpendicularly to the planar surface. The side plates extend from the main body to the distal edge of the horizontal body. A plurality of parallel terminal-receiving passages are formed by a plurality of generally parallel partitions disposed perpendicularly to the horizontal body in a cross-wise fashion. The partitions extend from the proximal side of the main body to the distal edge of the planar surface. Conductive terminals may be inserted into the passages and a ramped fixed shoulder is formed in each passage on the planar surface for retaining the terminals in the passage. Additionally, a flexible finger is provided for each passage for holding the terminals in position in the passage. Each flexible finger extends distally from the main body over one of the passages, and the distal tip of the finger contacts the terminal and provides resilient bias against the terminal when the terminal is installed in the passage. A terminal may be loaded into each passage in the insert and disposed in front of the fixed shoulder on the horizontal surface so that the tip of the terminal is adjacent to the distal edge of the horizontal surface, and the rear of the terminal abuts the fixed shoulder.

The housing portion of the invention includes a generally box-shaped casing having an upper wall, a lower wall, a pair of sidewalls, a front wall, and an open rear side, so that a hollow cavity is formed for receiving the insert portion of the invention. Guides are formed along the sidewalls on the inside of the housing cavity for contacting and guiding the side plates of the insert portion during insertion of the insert portion into the housing portion. Each of the upper and lower walls of the housing portion includes a transverse step formed along the expanse between the side walls. The upper and lower walls further include a transverse ramped locking area which also extends between the two side walls.

The transverse step serves as part of a TPA system for preventing assembly of the insert portion into the housing portion if a terminal is not properly seated in one of the passages. When a terminal is not properly seated in a passage, the finger for that passage will extend outward more than the rest of the fingers, and this finger will contact the transverse step on the upper or lower wall. The transverse step will prevent further insertion of the insert and alert a technician assembling the component as to the incorrectly positioned terminal. When all terminals are properly seated, there is sufficient clearance between the fingers and the transverse steps to allow the insert portion to be completely inserted into the housing portion. Furthermore, as complete insertion occurs, the fingers on the insert contact the ramped locking area. The ramped locking area forces the fingers against the terminals, thereby securely locking the terminals in position. Thus, the configuration of the invention also provides a locking feature to prevent dislodgement of the terminals.

Accordingly, the present invention provides a reliable and ergonomic connector component, TPA mechanism, and locking mechanism. The present invention ensures correct and secure positioning of terminals, and correct assembly of a connector component, while also preventing unintentional removal of the terminals. Furthermore, while the preferred embodiment of the invention is described in conjunction with a socket component for a particular two-part electrical connector for a wiring harness, it may be equally well used with other connector applications, such as pin-type terminals, plug components, or the like, and is not limited to use with the particular socket component shown.

BRIEF DESCRIPTION OF THE DRAWINGS

The foregoing and additional objects, features, and advantages of the present invention will become apparent to those of skill in the art from a consideration of the following detailed description of a preferred embodiment of the invention, taken in conjunction with the accompanying drawings.

FIG. 1 illustrates a perspective view of a connector system incorporating the connector component of the invention. FIG. 1 includes a CPA device, a plug component of a connector, and a socket component of the preferred embodiment of the present invention illustrating the insert portion and the housing portion.

Figure 2D:
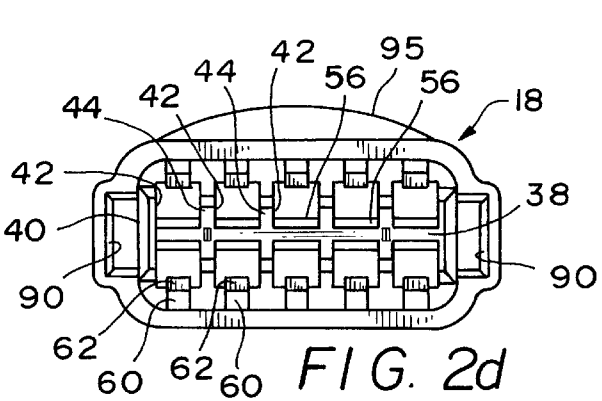
FIG. 2*d* illustrates a front view of the insert portion illustrated in FIG. 2*a*.
Figure 2B:
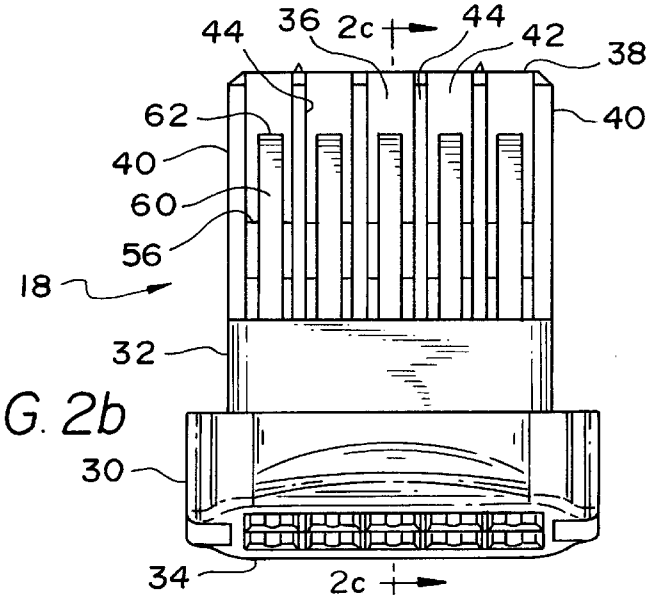
FIG. 2*b* illustrates a plan view of the insert portion illustrated in FIG. 2*a*.
Figure 2A:
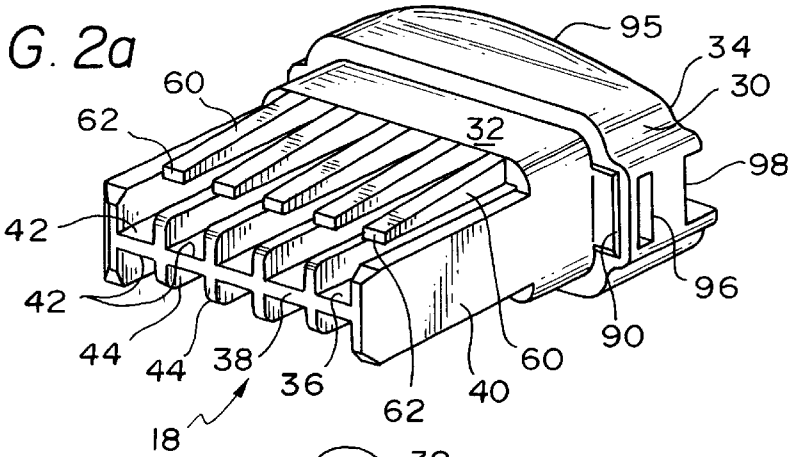
FIG. 2*a* illustrates an enlarged reverse-angle perspective view of the insert portion illustrated in FIG. 1.

FIG. 2*a* illustrates an enlarged reverse-angle perspective view of the insert portion illustrated in FIG. 1.

FIG. 2*b* illustrates a plan view of the insert portion illustrated in FIG. 2*a*.

Figure 2C:
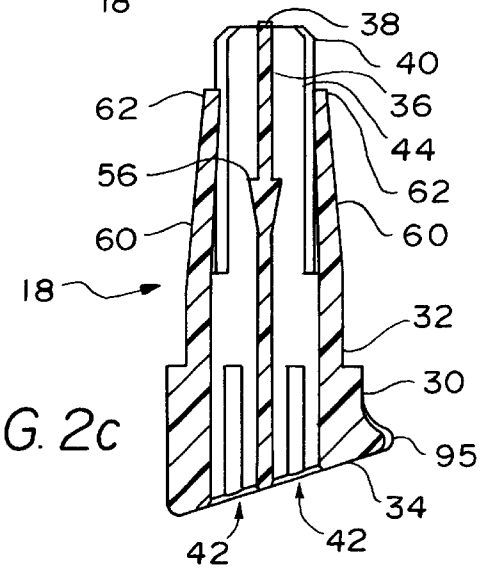
FIG. 2*c* illustrates a cross sectional view of the insert portion illustrated in FIG. 2*b*, as taken along line 2*c*—2*c*.

FIG. 2*c* illustrates a cross sectional view of the insert portion illustrated in FIG. 2*b*, as taken along line 2*c*—2*c*.

FIG. 2*d* illustrates a front view of the insert portion illustrated in FIG. 2*a*.

Figures 3A, 3B, 3C, 3D, 3E:
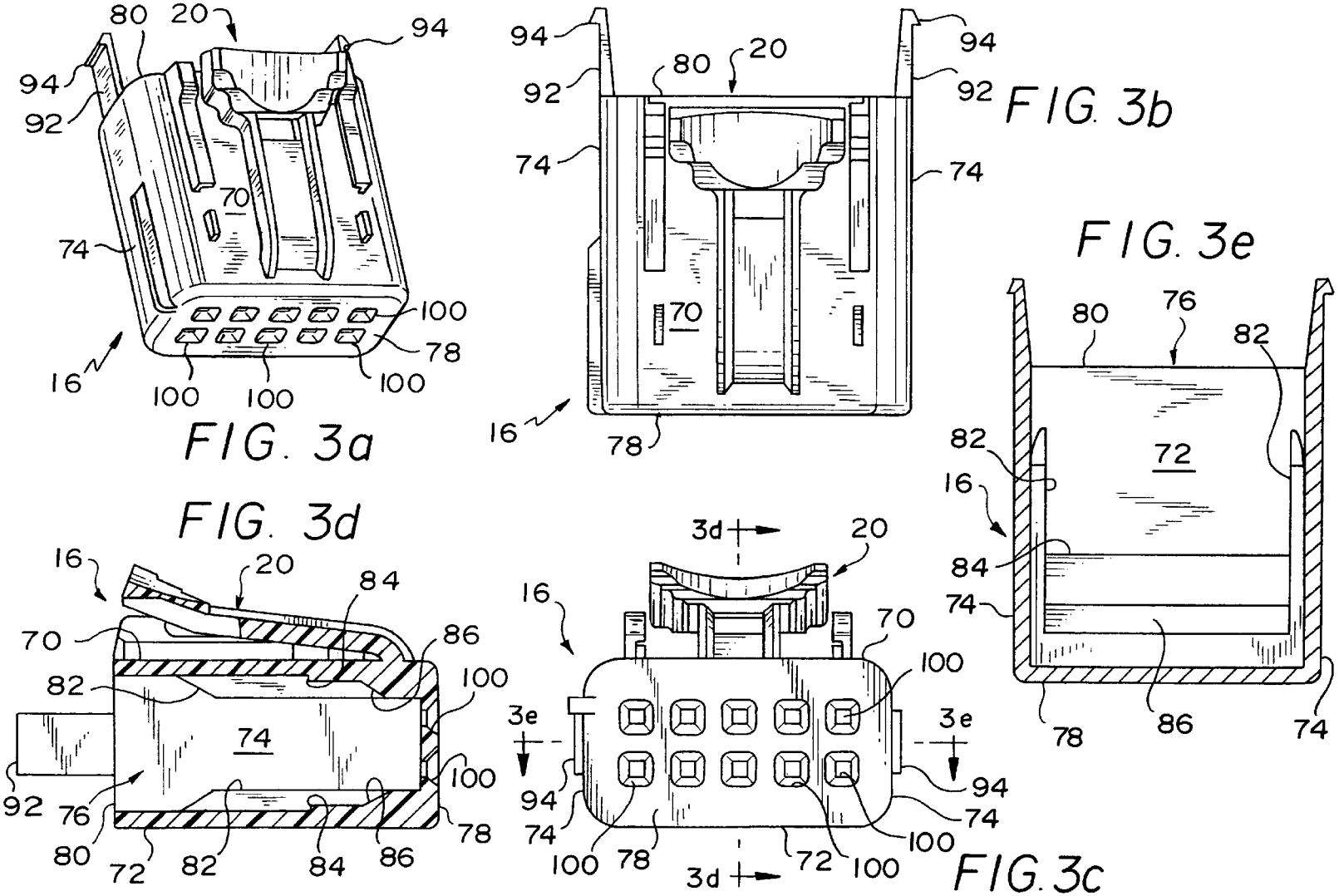
FIG. 3*a* illustrates a reduced-scale perspective view of the connector housing portion illustrated in FIG. 1.
FIG. 3*b* illustrates an enlarged plan view of the housing portion illustrated in FIG. 3*a*.
FIG. 3*c* illustrates a front view of the housing portion illustrated in FIG. 3*b*.
FIG. 3*d* illustrates a cross sectional view of the housing portion illustrated in FIG. 3*c*, as taken along line 3*d*—3*d*.
FIG. 3*e* illustrates a cross sectional view of the housing portion illustrated in FIG. 3*c*, as taken along line 3*e*—3*e*.

FIG. 3*a* illustrates a reduced-scale perspective view of the connector housing portion illustrated in FIG. 1.

FIG. 3*b* illustrates an enlarged plan view of the housing portion illustrated in FIG. 3*a*.

FIG. 3*c* illustrates a front view of the housing portion illustrated in FIG. 3*b*.

FIG. 3*d* illustrates a cross sectional view of the housing portion illustrated in FIG. 3*c*, as taken along line 3*d*—3*d*.

FIG. 3*e* illustrates a cross sectional view of the housing portion illustrated in FIG. 3*c*, as taken along line 3*e*—3*e*.

FIG. 4 illustrates a cross sectional view of the insert portion and the housing portion prior to insertion, with a terminal located in one of the passages.

FIG. 5*a* illustrates a side view of the insert portion and the housing portion in the pre-lock position, during which terminals might typically be inserted into the terminal passages.

FIG. 5*b* illustrates a cross-sectional view of the assembly of FIG. 5*a*.

FIG. 6*a* illustrates a side view of the insert portion and the housing portion with the insert portion fully inserted to the locked position.

FIG. 6*b* illustrates a cross-sectional view of the assembly illustrated in FIG. 6*a*.

FIG. 7 illustrates a cross-sectional view of the insert portion being inserted into the housing portion with a misaligned terminal in one of the passages, thereby illustrating the TPA feature of the invention.

DETAILED DESCRIPTION

Turning now to a more detailed description of the present invention, there is illustrated in FIG. 1 a preferred embodiment of an electrical connector system including a plug connector component 10, a connector position assurance ("CPA") device 12, and a two-piece socket connector component 14 in accordance with the present invention. Socket component 14 is designed as a two-part assembly and comprises a connector housing portion 16 and a connector insert portion 18. Housing portion 16 and insert portion 18 are arranged so that insert portion 18 may be placed into housing portion 16 to facilitate installation of conductive terminals (not shown in FIG. 1). Socket component 14 is designed to receive a plurality of socket-type terminals (not shown). Plug component 10 contains a plurality of pin-type terminals (not shown). Socket component 14 may be inserted into plug component 10 for forming an electrical connection. During insertion of socket component 14 into plug component 10, the pin terminals enter into the socket terminals for making the electrical connection, as is known in the art.

A latch mechanism 20 is provided on housing portion 16 for latching socket component 14 to the plug component 10 during assembly. Following assembly of socket component 14 and plug component 10, CPA device 12 may be used to lock the connector components 10, 14 together in the latched condition. Latch mechanism 20 and CPA device 12 are described in more detail in applicants' co-pending patent application entitled "CONNECTOR POSITION ASSURANCE DEVICE", filed on an even date herewith, to the same inventors as herein, to the same assignee as herein, under U.S. patent application Ser. No. 09/302,992, and the disclosure of which is incorporated herein by reference.

As illustrated in FIGS. 2*a*–2*d*, insert portion 18 includes a main body 30 which is generally rectangular in cross section, and which includes a mating end 32 and a non-mating proximal end 34. Main body 30 has a planar surface 36 centrally disposed in main body 30 when viewed from either end 32, 34. Planar surface 36 extends from the proximal end 34 of main body 30, through main body 30, and outward from the mating end 32 of main body 30 to form a distal edge 38. Generally rectangular side plates 40 are located on either side of planar surface 36 and are integrally formed perpendicularly to the major plane of planar surface 36. Side plates 40 extend from mating end 32 of main body 30 to distal edge 38 of planar surface 36.

A plurality of parallel terminal-receiving channels or passages 42 are formed by a plurality of generally parallel spaced partitions 44 disposed perpendicularly to horizontal surface 36 in a cross-wise fashion. Partitions 44 are generally rectangular and extend through main body 30 from proximal end 34 to the distal edge 38 of planar surface 36. As also illustrated in FIG. 4, conductive terminals 50 may be inserted into passages 42 through proximal end 34, with one terminal 50 being placed in each passage 42. During installation, each terminal 50 is inserted into a passage 42 until the terminal tip 52 is adjacent to distal edge 38 of planar surface 36. A conductive wire 54 is attached to each terminal 50, and extends back through passage 42 and out of proximal end 34.

To retain terminals 50 in passages 42, a ramped fixed shoulder 56 is formed on planar surface 36 in each passage 42. Once a terminal 50 is installed in a passage 42, the rear edge 58 of terminal 50 butts up against fixed shoulder 56 for preventing movement of terminal 50 toward proximal end 34 of insert portion 18. Additionally, to further retain terminals 50 within passages 42, flexible fingers 60 are provided extending distally of mating end 32 in a cantilevered fashion. Fingers 60 extend over passages 42 so that one finger 60 extends over each passage 42 for holding terminals 50 in position in passages 42. Distal tips 62 of each finger 60 contact terminals 50 and provide resilient bias against terminals 50 when terminals 50 are installed in passages 42. The inherent resilient bias of fingers 60 aids in holding terminals 50 in position in passages 42 both during installation and following assembly. Furthermore, insert portion 18 and housing portion 16 may be constructed of any suitable material, but are preferably molded from dielectric thermoplastic having sufficient inherent resilience to allow portions of the components, such as fingers 60 and latch mechanism 20, to flex under force and then recoil to their initial configurations.

As illustrated in FIGS. 3*a*–3*e*, housing portion 16 is formed as a generally box-shaped casing having an upper wall 70, a lower wall 72, a pair of sidewalls 74, a front wall 78, and an open rear side 80, so that a hollow cavity 76 is formed for receiving insert portion 18 of the invention. Two sets of guides 82 are formed along sidewalls 74 on the inside of housing 16. Guides 82 are provided to contact and guide side plates 40 during insertion of insert portion 18 into housing portion 16. Guides 82 ramp away from upper wall 70 and lower wall 72 so that insert portion 18 may be easily inserted into housing 16 and automatically centered.

In addition, upper wall 70 and lower wall 72 each include a transverse step 84 formed across their expanse between side walls 84. Steps 84, along with fingers 60, serve as a TPA system for preventing assembly of insert portion 18 into housing portion 16 if a terminal 50 is not properly seated in its passage 42. As illustrated in FIG. 7, when a terminal 50 is not properly seated, the finger 60 bearing against that terminal 50 will extend outward to a greater extent than the remaining fingers 60. Distal tip 62 of this protruding finger 60 will contact step 84 on upper wall 70 or lower wall 72. Step 84 will prevent further insertion of insert portion 18 and alert a technician assembling the component 14 as to the incorrectly positioned terminal 50. However, when all terminals 50 are properly seated, there is sufficient clearance between steps 84 and fingers 60 to allow insert portion 18 to be completely inserted into housing portion 16.

Housing portion 16 further includes transversely-formed ramped locking areas 86. Ramped locking areas 86 extend transversely across upper wall 70 and lower wall 72 between sidewalls 74. Locking areas 86, along with fingers 60 and fixed shoulders 56, serve as a locking mechanism for securing terminals 50 within passages 42. Following proper installation of terminals 50 into passages 42, insert portion 18 is moved from the pre-lock position illustrated in FIGS. 5*a* and 5*b* to the fully locked position illustrated in FIGS. 6*a* and 6*b*. During full insertion of insert portion 18 into housing 16, fingers 60 contact ramped locking areas 86. Locking areas 86 forces fingers 60 tightly against terminals 50, thereby securely locking terminals 50 in position in passages 42. The proximity of fingers 60, combined with the solid stop of fixed shoulder 56 and the proximity of front wall 78 all serve to securely retain terminals 50 in position and prevent their removal.

To enable insert portion 18 to be securely installed in housing 16, main body 30 of insert portion 18 includes latch portals 90 formed on either side. Latch portals 90 are configured to receive rearwardly-extending latch arms 92 located on either side of housing portion 16. Latch arms 92 include locking tabs 94 formed on their ends. A pre-lock aperture 96 is formed in the side of each latch portal 90 for receiving locking tabs 94 and for retaining insert portion 18 assembled to housing portion 16 in a pre-lock position, as illustrated in FIGS. 5*a* and 5*b*, and the purpose of which will be described below. When insert portion 18 is fully inserted into housing portion 16, as illustrated in FIGS. 6*a* and 6*b*, tabs 94 are slid further back and exit the proximal sides 98 of latch portals 90. Locking tabs 94 engage with the proximal sides 98 of latch portals 90 for securely locking insert portion 18 to housing portion 16. Once this configuration is reached, insert portion 18 cannot be removed from housing portion 16 until tabs 94 are manually disengaged from the proximal sides 98 of latch portals 90. This may be accomplished by flexing tabs 94 inward and sliding insert portion 18 away from housing portion 16. A projecting grip area 95 may be provided on main body 30 of insert portion 18 for facilitating removal of insert portion 18 from housing portion 16.

In use, insert portion 18 is inserted into cavity 76 of housing portion 16 and moved to the pre-lock position illustrated in FIGS. 5*a* and 5*b*. This is the preferred position for inserting terminals 50 into passages 42. (Although alternatively, terminals 50 may be installed prior to insertion of insert 18 into housing 16, as illustrated in FIG. 4.) In the prelock position, tabs 94 are located in pre-lock apertures 96 in latch portals 90, and distal tips 62 of fingers 60 have not yet reached steps 84. A desired number of terminals 50 are then installed into passages 42, one per passage, and typically, all of passages 42 will receive a terminal 50. Terminals 50 are installed by inserting a terminal 50 into a passage 42 and pushing terminal 50 forward. As terminals 50 are pushed forward, forward tip 52 will ride up ramped fixed shoulder 56, causing finger 60 to flex outward. Then as rear edge 58 of terminal 50 passes ramped fixed shoulder 56, the resilience of finger 60 will force terminal 50 back against planar surface 30, snapping terminal 50 into the installed position. Once all terminals 50 are installed, insert portion 18 is pushed forward into housing 16. If terminals 50 are too far forward, ramp locking areas 86 and front wall 78 will force terminals 50 back against fixed shoulder 56. If a terminal 50 is not completely installed, as illustrated in FIG. 7, the finger 60 adjacent to that terminal 50 will project outward and contact step 84 as insert portion 18 is moved toward the full locked position. This will alert the technician assembling component 14 that a terminal 50 is improperly positioned. The technician will then be able to check the positions of terminals 50 within passages 42.

When insert portion 18 is moved to the full locked position, locking tabs 94 engage with proximal edges 98 of latching portals 90, securely holding insert portion 18 within housing portion 16. In the full locked position, locking areas 86 prevent any movement of fingers 60. Thus, terminals 50 are locked in position within passages 42 by fixed shoulders 56, fingers 60, and front wall 78 of housing portion 16. In this position, terminals 50 are aligned with terminal openings 100. Terminal openings 100 pass through front wall 78, and enable pin-type terminals (not shown) to be inserted to form an electrical connection with terminals 50. To remove terminals 50 from passages 42, insert portion 18 must first be unlatched from housing portion 16 by releasing tabs 94 from engagement with latching portals 90. This is accomplished by flexing latch arms 92 inward, and, accordingly, no special tools are required for disassembly.

From the foregoing it will be apparent that there is provided a novel TPA system and locking mechanism for use in securing terminals within a connector component. The TPA system prevents assembly of components in which the terminals are not properly seated. Furthermore, the present invention locks the terminals in position without requiring holes in the terminals 50 or positive connection of the terminals to the housing portion 16 of component 14. In addition, the insert portion 18 may be removed from the housing portion 16 easily and without special tools. Thus, although the present invention has been described in terms of preferred embodiments, it will be apparent that variations and modifications may be made without departing from the true spirit and scope thereof, as set forth in the following claims.

What is claimed:

1. A connector component for receiving at least one conductive terminal, said component comprising:

an insert portion, said insert portion having at least one passage for receiving a terminal, said insert portion further having a resilient finger extending over said passage for contacting the terminal;

a shoulder for abutting against a portion of the terminal for preventing removal of the terminal from said passage, said shoulder being formed in said passage on a surface opposite to said resilient finger so that the terminal is retained against said shoulder by said finger; and a housing portion having a cavity for receiving said insert, said housing portion including a ramped locking area within said cavity, whereby, when said insert portion is inserted into said housing portion, said ramped locking area prevents said finger from flexing away from the terminal, thereby retaining the terminal in contact with said shoulder so that the terminal is securely retained within said passage.

2. The component of claim 1 further including a transverse step formed within said cavity, said step being positioned for contacting said finger if said terminal is not seated properly within said passage during full insertion of said insert portion, but said step providing sufficient clearance for full insertion of said insert portion if said terminal is seated properly within said passage.

3. The component of claim 1 wherein said ramped locking area forces said finger tightly against said terminal, thereby forcing said terminal tightly against said shoulder and said surface of said passage.

4. The component of claim 1 further including a planar surface which forms said surface of said passage opposite to said finger, and further wherein there are a plurality of said passages, each said passage being formed at least in part by a plurality of generally parallel spaced partitions disposed perpendicularly to said planar surface, each said passage having one of said fingers extending over said passage.

5. The component of claim 4 wherein said passages are formed on both sides of said planar surface.

6. The component of claim 4 wherein said insert portion includes a main body, said passages passing through said main body and extending distally therefrom.

7. The component of claim 6 further including a latch portal located on said main body, said latch portal being configured for receiving a latch arm on said housing portion, said latch portal further including a pre-lock aperture for latching said insert portion in a pre-lock configuration within said housing portion.

8. A two-piece connector component for receiving at least one conductive terminal, said component comprising:

an insert portion, said insert portion including a main body having at least one terminal-receiving passage extending therethrough and distally thereof, said passage having a surface having a shoulder formed thereon, said insert portion further including a cantilevered resilient finger extending from said main body over said passage in a position opposed to said surface and said shoulder whereby a conductive terminal may be inserted into said passage and retained by said shoulder while said finger contacts the terminal to retain the terminal in contact with said shoulder and said surface of said passage; and a housing portion, said housing portion having a cavity for receiving said insert portion.

9. The component of claim 8 wherein said housing further includes a top wall, a bottom wall and a pair of side walls for forming said cavity, and a transverse step formed in at least one of said top wall or said bottom wall, said transverse step being positioned for contacting said finger if the terminal is not properly seated within said passage.

10. The component of claim 9 wherein at least one of said top wall or bottom wall includes a ramped locking area for preventing movement of said finger away from the terminal following complete insertion of said insert portion into said housing portion.

11. The component of claim 10 wherein said ramped locking area forces said finger more tightly against said terminal, thereby forcing said terminal more tightly against said shoulder and said surface of said passage.

12. The component of claim 8 further including a planar surface which forms said surface of said passage opposed to said finger, and further wherein there are a plurality of said passages, each said passage being formed at least in part by a plurality of generally parallel spaced partitions disposed perpendicularly to said planar surface, each said passage having one of said fingers extending over said passage.

13. The component of claim 8 wherein said insert portion includes a latch portal located on said main body, said latch portal being configured for receiving a latch arm on said housing portion for latching said insert portion to said housing portion in the fully locked position.

14. The component of claim 13 wherein said latch portal further includes a pre-lock aperture for latching said insert portion in an intermediate pre-lock configuration within said housing portion.

15. In combination, a two-piece connector component and a plurality of conductive terminals, said combination comprising:

a plurality of conducting terminals, each said terminal having a forward tip and a rear edge;

an insert portion, said insert portion including a main body having a plurality of terminal receiving passages extending through said main body and terminating at a distal edge, said insert portion further including a shoulder located on a surface in each said passage for contacting said rear edge of one of said terminals when one of said terminals is positioned within one of said passages with said forward tip of said terminal adjacent to said distal edge, said insert portion further including a plurality of flexible fingers positioned for contacting said terminals when said terminals are located within said passages and for resiliently urging said terminals against said surfaces of said passages having said shoulders; and a housing portion, said housing portion including a cavity for receiving said insert portion, said housing portion further including at least one ramped locking area within said cavity for preventing movement of said fingers away from said terminals when said insert portion is fully inserted into said cavity so that removal of said terminals from said passages is prevented by said shoulders.

16. The combination of claim 15 further including a planar surface extending from said main body to said distal edge and which forms said surfaces of said passages opposite to said fingers, and further wherein each said passage is formed at least in part by a plurality of generally parallel spaced partitions disposed perpendicularly to said planar surface.

17. The combination of claim 15 wherein said insert portion includes a latch portal located on said main body, said latch portal being configured for receiving a latch arm located on said housing portion for latching said insert portion to said housing portion when said insert portion is fully inserted into said cavity.

18. The combination of claim 17 wherein said latch portal further includes a pre-lock aperture for latching said insert portion in an intermediate a pre-lock configuration within said housing portion.

19. The combination of claim 15 wherein said housing portion includes an upper wall, a lower wall, and a pair of side walls, with a step extending transversely between said sidewalls on each of said upper and lower walls for contacting said fingers if one or more of said terminals are not properly seated ion one or more of said passages.

20. The combination of claim 15 wherein said ramped locking area forces said fingers more tightly against said terminals, thereby forcing said terminals more tightly against said shoulders and said surfaces of said passages.

* * * * *